US007618331B2

(12) United States Patent
Hirano

(10) Patent No.: US 7,618,331 B2
(45) **Date of Patent: *Nov. 17, 2009**

(54) GOLF CLUB HEAD

(75) Inventor: Tomoya Hirano, Kobe (JP)

(73) Assignee: SRI Sports Limited, Kobe-Shi, Hyogo-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/010,860

(22) Filed: Jan. 30, 2008

(65) Prior Publication Data

US 2008/0248896 A1 Oct. 9, 2008

(30) Foreign Application Priority Data

Apr. 5, 2007 (JP) ..... 2007-099608

(51) Int. Cl.
*A63B 53/04* (2006.01)

(52) U.S. Cl. ..... 473/329; 473/342; 473/346

(58) Field of Classification Search ..... 473/324–350, 473/287–292; D21/747, 748
See application file for complete search history.

(56) References Cited

U.S. PATENT DOCUMENTS 2,087,685 A * 7/1937 Hackney ..... 473/349
3,814,437 A * 6/1974 Winquist ..... 473/350
D318,703 S * 7/1991 Shearer ..... D21/748
5,377,985 A * 1/1995 Ohnishi ..... 473/324
5,547,427 A * 8/1996 Rigal et al. ..... 473/345
5,595,552 A * 1/1997 Wright et al. ..... 473/332
D400,945 S * 11/1998 Gilbert et al. ..... D21/753
5,971,868 A * 10/1999 Kosmatka ..... 473/349
6,007,432 A * 12/1999 Kosmatka ..... 473/324
D418,887 S * 1/2000 Williams, Jr. ..... D21/749
6,379,262 B1 * 4/2002 Boone ..... 473/324
6,482,107 B1 * 11/2002 Urbanski et al. ..... 473/331
6,746,343 B2 * 6/2004 Yoneyama ..... 473/342
6,800,038 B2 * 10/2004 Willett et al. ..... 473/329
6,800,039 B1 * 10/2004 Tseng ..... 473/329
6,840,872 B2 * 1/2005 Yoneyama ..... 473/346
6,899,638 B2 * 5/2005 Iwata et al. ..... 473/329
6,926,618 B2 * 8/2005 Sanchez et al. ..... 473/329
7,018,303 B2 * 3/2006 Yamamoto ..... 473/329
7,220,190 B2 * 5/2007 Hirano ..... 473/342
D553,704 S * 10/2007 Nunez et al. ..... D21/759

(Continued)

FOREIGN PATENT DOCUMENTS

JP 2002-315854 A 10/2002

(Continued)

*Primary Examiner*—Sebastiano Passaniti
(74) *Attorney, Agent, or Firm*—Birch, Stewart, Kolasch & Birch, LLP

(57) ABSTRACT

A golf club head comprises a face portion having a front face defining the club face and a rear face facing a hollow, wherein the face portion is provided on the rear face with an upper rib, a lower rib, a toe-side groove and a heel-side groove which extend radially from a thickest central region, so as to form a toe-side upper region, a toe-side lower region, a heel-side upper region and a heel-side lower region. The thickness distribution of the face portion satisfies the following magnitude relations: (Central region>=upper rib); (central region>=Lower rib); (upper rib>Toe-side upper region>Toe-side groove); (Lower rib>Toe-side lower region>Toe-side groove); (upper rib>Heel-side upper region>Heel-side groove); and (Lower rib>Heel-side lower region>Heel-side groove).

14 Claims, 7 Drawing Sheets

U.S. PATENT DOCUMENTS

| | | | | |
|---|---|---|---|---|
| 7,442,132 | B2 * | 10/2008 | Nishio | 473/342 |
| 2003/0144079 | A1 * | 7/2003 | Yoneyama | 473/346 |
| 2004/0132544 | A1 * | 7/2004 | Doi | 473/345 |
| 2008/0004129 | A1 * | 1/2008 | Lin et al. | 473/332 |
| 2008/0125246 | A1 * | 5/2008 | Matsunaga | 473/346 |

FOREIGN PATENT DOCUMENTS

| | | | |
|---|---|---|---|
| JP | 2006-175135 | A | 7/2006 |

* cited by examiner ( Ref.1 )

( Ref.2 )

( Ref.3 )

( Ref.4 )

GOLF CLUB HEAD

BACKGROUND OF THE INVENTION

The present invention relates to a golf club head, more particularly to a face portion having a specific thickness distribution.

Recently, there have been widely used wood-type hollow golf club heads whose face portion is made of a thin metal material in order to increase the carry distance of the hit ball, while providing a thicker central region to provide the necessary strength and durability. In this face structure, since the central region is surrounded by the relatively thin region, there is a tendency that the boundary portion between the thick central region and the relatively thin surrounding region becomes a weak point at the time of off-center shots.

In order to solve this problem, it has been proposed in US-2003-144079-A1 that the thin surrounding region is provided with narrow ribs extending radially from the central thick region, wherein the narrow ribs are disposed around the central region at almost same angular intervals.

The narrow ribs can reinforce the thin surrounding region, and the strength and durability can be increased. But, the deflection of the face portion at the time of off-center shots is decreased and as a result, the carry distance of the hit ball is also decreased.

SUMMARY OF THE INVENTION

It is therefore, an object of the present invention to provide a golf club head, in which the loss of carry distance due to off-center shots can be minimized, without sacrificing the durability.

According to the present invention, a golf club head comprises: a face portion having a front face defining the club face and a rear face facing a hollow; a crown portion; and a sole portion, wherein the face portion is provided on the rear face with: a central region defining the largest thickness of the face portion; an upper rib extending from the central region toward the crown portion; a lower rib extending from the central region toward the sole portion; a toe-side groove extending from the central region toward the toe; and a heel-side groove extending from the central region toward heel, thereby forming: a toe-side upper region between the toe-side groove and the upper rib; a toe-side lower region between the toe-side groove and the lower rib; a heel-side upper region between the heel-side groove and the upper rib; and a heel-side lower region between the heel-side groove and the lower rib, and the face portion has a thickness distribution satisfying the following magnitude relations:

Central region>=upper rib;

Central region>=Lower rib;

Upper rib>Toe-side upper region>Toe-side groove;

Lower rib>Toe-side lower region>Toe-side groove;

Upper rib>Heel-side upper region>Heel-side groove; and

Lower rib>Heel-side lower region>Heel-side groove.

Preferably, both of the upper rib and the lower rib extend along a first straight line which is inclined to the heel from the sole portion towards the crown portion at an inclination angle of from 10 to 40 degrees with respect to the crown-and-sole direction, and both of the toe-side groove and the heel-side groove extend along a second straight line which is inclined to the heel from the toe towards the heel at an inclination angle of from 10 to 40 degrees with respect to the toe-and-heel direction.

In order to minimize the loss of carry distance due to off-center shots, the present inventor checked ball hitting positions of a large number of golfers, and found that the ball hitting position of the average golfers apparently have a tendency to disperse along one direction. FIG. 11 shows a typical example of the distribution map of the hitting positions of the average golfers. As apparent from this figure, the hitting positions concentrate along an aslant straight line N extending between the toe and heel.

According to the present invention, on the toe-side and the heel-side of the central region, the thickness of the face portion is reduced by the two grooves, therefore, even if the ball hitting position is off-centered to the heel or toe, the hit part is effectively deflected and thereby the decrease in the rebound performance due to the off-center shot can be compensated, and the loss of the carry distance can be minimized. On the other hand, the necessary durability for the face portion can be secured by the thick central region, upper rib and lower rib. Further, between the two grooves and two ribs, the four regions having middle thicknesses are formed, therefore, the rigidity change becomes gradual and the stress at impact is dispersed, therefore, although the grooves are formed, the decrease in the durability due to the grooves can be prevented.

In this specification, the dimensions, positions and directions refer to those under the standard state of the club head unless otherwise noted.

The standard state of the club head is such that the club head is set on a horizontal plane HP so that the axis CL of the clubshaft(or the shaft inserting hole 7*a* of the hosel) is inclined at the lie angle alpha while keeping the axis on a vertical plane VP, and the club face 2 forms its loft angle with respect to the horizontal plane HP.

The toe-and-heel direction TH is a horizontal direction parallel to the vertical plane VP.

The crown-and-sole direction CS is a vertical direction perpendicular to the horizontal plane HP.

The sweet spot SS is the point of intersection between the club face 2 and a straight line drawn normally to the club face from the center of gravity G of the head.

The front view means a view perpendicular to the vertical plane VP.

The shape in the front view of an object means a shape of the object projected on the vertical plane VP.

The area in the front view of an object means an area of the object projected on the vertical plane VP.

DESCRIPTION OF THE PREFERRED EMBODIMENTS

Figure 1:
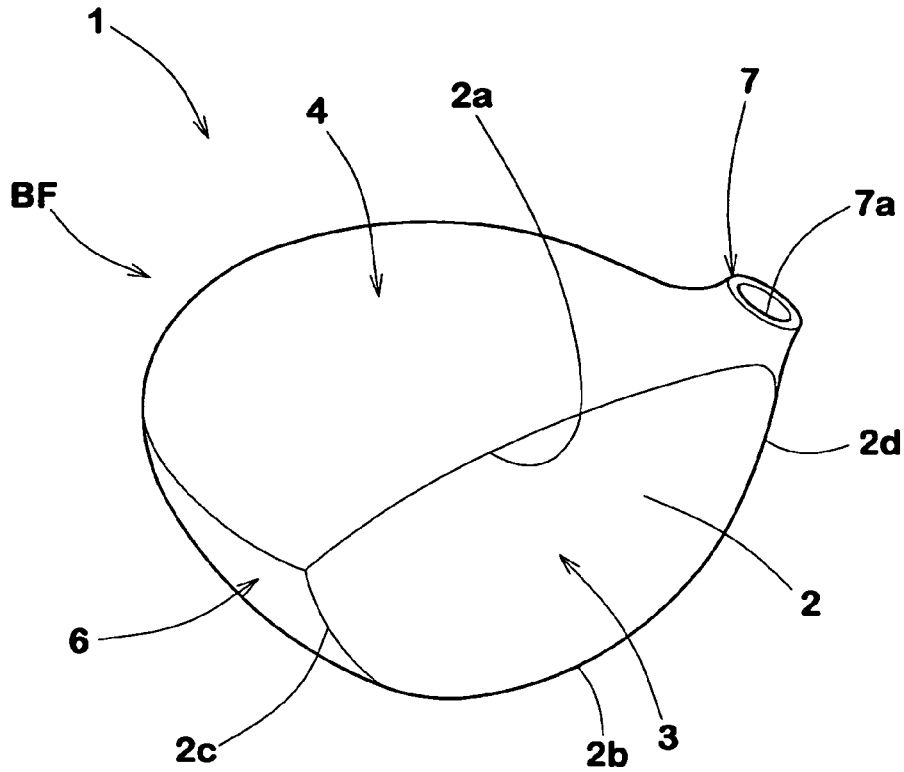
FIG. 1 is a perspective view of a wood-type golf club head according to the present invention.

Embodiments of the present invention will now be described in detail in conjunction with accompanying drawings.

In the drawings, golf club head 1 according to the present invention is a hollow head for a wood-type golf club such as driver (#1) or fairway wood.

In the case of a wood-type club head for a driver (#1), it is preferable that the head volume is set in a range of not less than 380 cc, more preferably not less than 400 cc, still more preferably not less than 420 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 470 cc, more preferably not more than 460 cc.

The mass of the club head 1 is preferably set in a range of not less than 180 grams, more preferably not less than 185 grams in view of the strength and swing balance, but not more than 220 grams, more preferably not more than 215 grams in view of the directionality and traveling distance of the ball.

Figure 2:
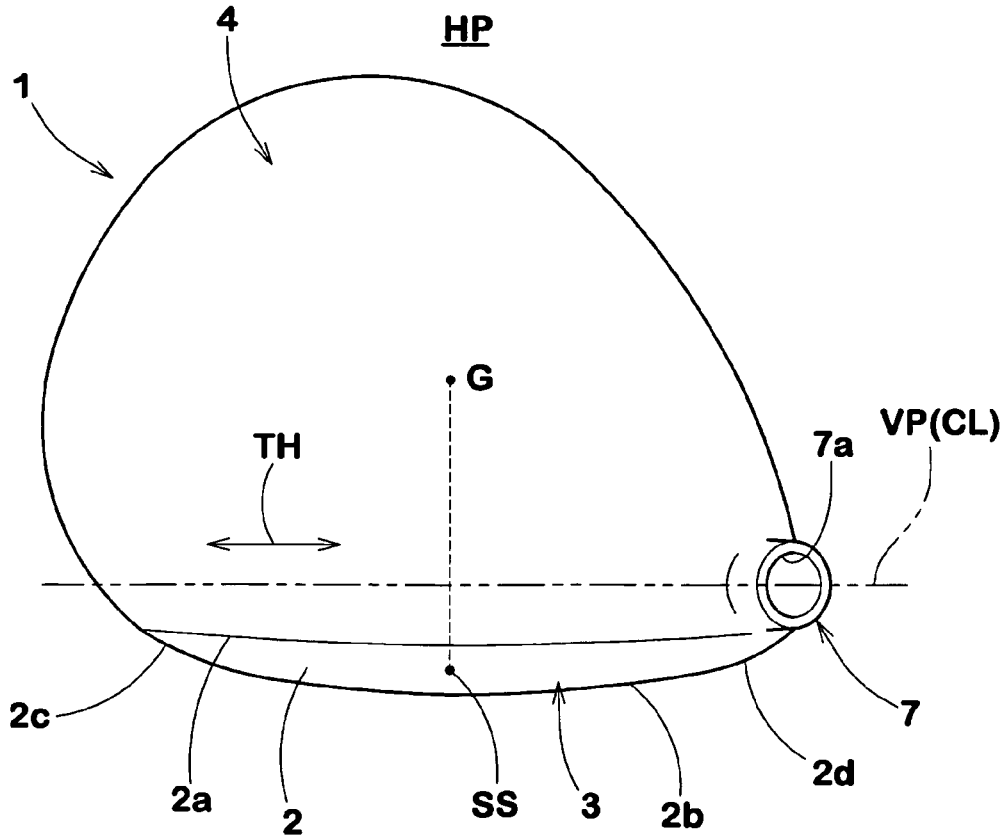
FIG. 2 is a top view thereof.

As shown in FIGS. 1 and 2, the head 1 comprises: a face portion 3 whose front face defines a club face 2 for hitting a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel-side end of the crown to be attached to an end of a club shaft (not shown) inserted into the shaft inserting hole 7*a*. Thus, the club head 1 has a shell structure with the thin wall and a hollow (i) behind the face portion 3.

In this embodiment, the hollow (i) is void, but a filler, e.g. foamed plastic and the like can be disposed therein so as not to contact with the face portion 3.

The club head 1 can be a two- or three- or four-piece structure. In this embodiment, a two-piece structure is adopted, which comprises: a main shell 1B made of at-least one kind of metal material; and a face plate 1A made of a metal material and attached to the front of the main shell 1B so as to cover the front opening O of the main shell 1B.

Figure 3:
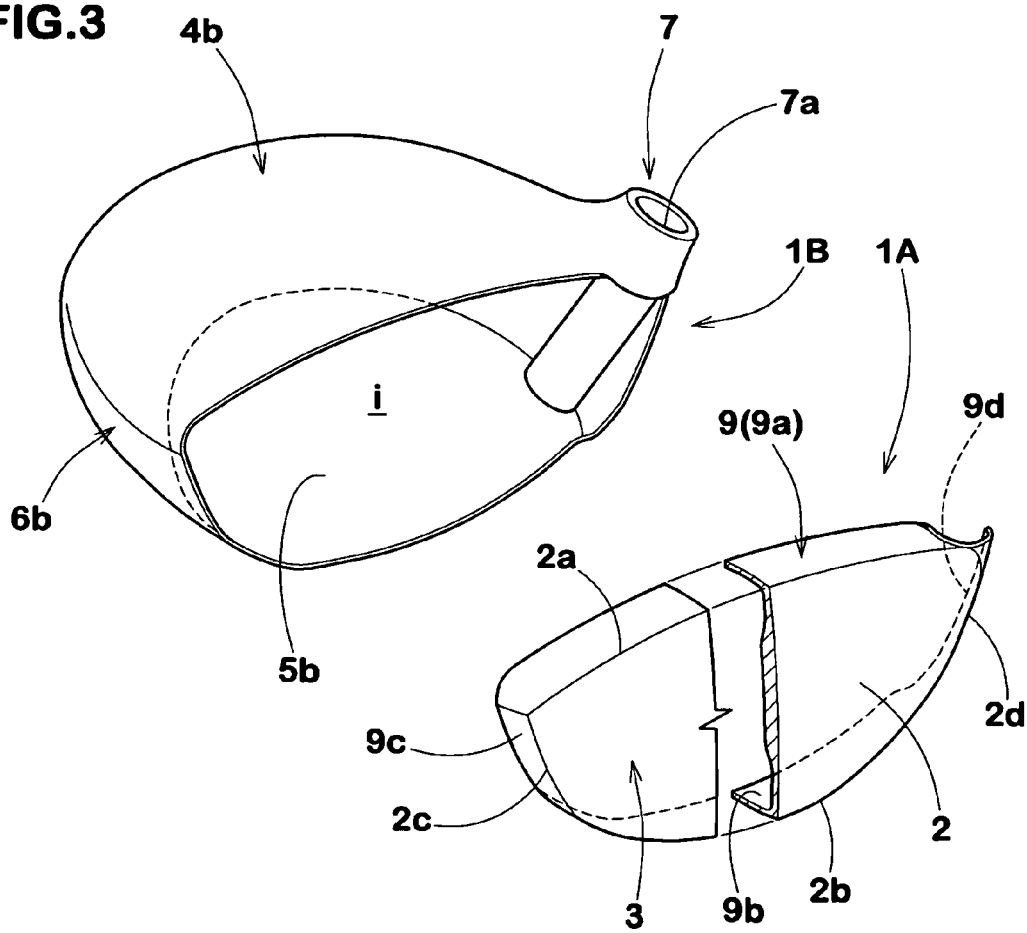

FIG. 3 shows an example of the two-piece structure, wherein the face plate 1A forms the entirety of the face portion 3, and the backwardly extending turnbacks 9*a*, 9*b*, 9*c* and 9*d* are formed along the edges 2*a*, 2*b*, 2*c* and 2*d* of the club face 2 since the turnbacks 9*a*, 9*b*, 9*c* and 9*d* form the front zones of the respective portions 3, 4 and 5, the main shell 1B forms the remainder of the club head. Namely, the main shell 1B is integrally made up of: a major posterior part 4*b* of the crown portion 4; a major posterior part 5*b* of the sole portion 5; a major posterior part 6*b* of the side portion 6; and the hosel portion 7.

Figure 4:
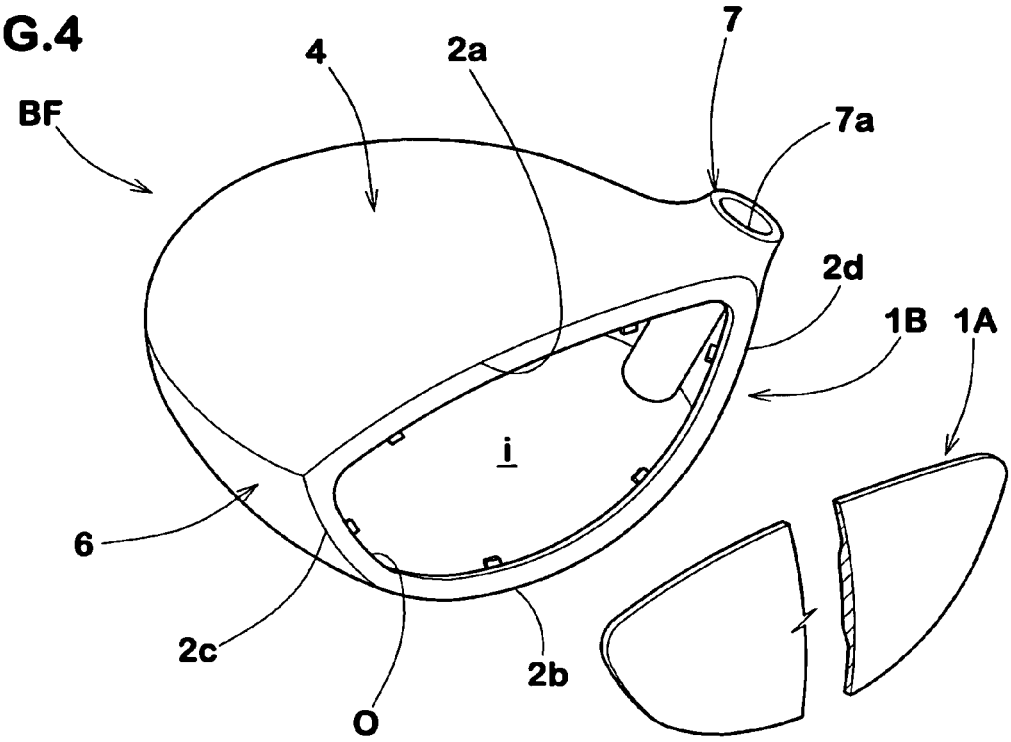
FIGS. 3 and 4 are exploded perspective views each showing a two-piece structure which can be adopted to construct the golf club head.

FIG. 4 shows another example of the two-piece structure, wherein the face plate 1A is a metal plate which is slightly smaller than the club face 2 and forms a major part of the face portion 3. The turnback is not formed. The main shell 1B comprises the crown portion 4, sole portion 5, side portion 6 and hosel portion 7, and further a peripheral part of the face portion 3 between the peripheral edges 2*a*-2*d* of the club face 2 and the edge of the opening O into which the face plate 1A is fitted. In this example, the club face 2 is defined by the face plate 1A and the peripheral part.

In any case, the face plate 1A and main shell 1B are preferably made of metal materials having large specific tensile strength. Specifically, stainless steels, maraging steels, pure titanium, titanium alloys, magnesium alloys, aluminum alloys can be preferably used. As to the titanium alloys, Ti-6Al-4V, Ti-15V-3Cr-3Al-3Sn, Ti-15Mo-5Zr-3Al, Ti-13V-11Cr-3Al or the like can be preferably used.

The face plate 1A and the main shell 1B can be made of the same metal materials, but it is also possible that these are made out of different metal materials. Incidentally, in order to reduce the weight of the club head 1, a fiber reinforced resin may be used to form a part of the main shell 1B.

The face plate 1A can be manufactured by: hot forging the metal material in a form of a round bar for example; press molding the rolled metal material; or the like.

The main shell 1B can be manufactured by casting for example. In order to weld the face plate 1A and main shell 1B with each other, for example, plasma welding, Tig welding and laser welding can be preferably used.

As usual, the face portion 3 or club face 2 has a shape long in the toe-and-heel direction, therefore, the width in the toe-and-heel direction is larger than the height in the crown-and-sole direction.

If the club face 2 or the front face 2 of the face portion 3 is too small, there is a possibility that the rebound performance is deteriorated if too large on the other hand, there is a possibility that the weight of the face portion 3 increases and the center of gravity becomes shallow.

Therefore, the area in the front view of the front face 2 is preferably set in a range of not less than 36 sq.cm, more preferably not less than 38 sq.cm, but not more than 47 sq.cm, more preferably not more than 45 sq.cm. Since this area is substantially same as the area in the front view of the rear face 3B of the face portion 3, the above limitations are also applied to the area of the rear face 3B.

According to the present invention, the face portion 3 is provided on the rear face 3B with two ribs 10 and 11 and two grooves 13 and 14: namely, a central region 10 defining the largest thickness of the face portion 3; an upper rib 11 extending from the central region 10 toward the crown portion 4; a lower rib 12 extending from the central region 10 toward the sole portion 5; a toe-side groove 13 extending from the central region 10 toward the toe; and a heel-side groove 14 extending from the central region 10 toward heel, so as to form: a toe-side upper region 15 between the toe-side groove 13 and the upper rib 11; a toe-side lower region 16 between the toe-side groove 13 and the lower rib 12; a heel-side upper region 17 between the heel-side groove 14 and the upper rib 11; and a heel-side lower region 18 between the heel-side groove 14 and the lower rib 12.

The thickness of the face portion 3 satisfies the following magnitude relations:

Central region 10>=Upper rib 11;

Central region 10>=Lower rib 12;

Upper rib 11>Toe-side upper region 15>Toe-side groove 13;

Lower rib 12>Toe-side lower region 16>Toe-side groove 13;

Upper rib 11>Heel-side upper region 17>Heel-side groove 14; and

Lower rib 12>Heel-side lower region 18>Heel-side groove 14.

The central region 10 having the largest thickness TC includes the sweet spot SS and the centroid z of the shape in the front view of the rear face 3B of the face portion 3.

The shape in the front view of the central region 10 is generally an oval rather than a circle, being long in the toe-and-heel direction and similar to the shape of the face portion.

The thickness TC is preferably set in a range of not less than 3.10 mm, more preferably not less than 3.25 mm in order to provide sufficient durability for the face portion 3. However, if the thickness Tc becomes excessively increased, there is possibility that the rebound performance is deteriorated, and the depth of the center of gravity is decreased due to the increased face weight, and as a result, the directionality of the hit ball becomes worse. In this light, the thickness Tc is preferably set in a range of not more than 4.00 mm, more preferably not more than 3.85 mm. In this embodiment, the thickness TC is substantially constant, but it may be varied within the above-mentioned range.

If the central region 10 becomes excessively small, there is a possibility that the durability of the face portion 3 is decreased. Therefore, the area AC in the front view of the central region 10 is preferably set in a range of not less than 13%, more preferably not less than 15% of the area of the rear face 3B of the face portion 3 in the front view. However, if the central region 10 becomes excessively large, there is a possibility that the rebound performance of the club head 1 is deteriorated, and the face portion 3 is increased in the weight and the center of gravity becomes shallow, and as a result, the directionality of the hit ball becomes worse. In this light, the area AC is preferably set in a range of not more than 30%, more preferably not more than 25%, still more preferably not more than 23% of the area of the rear face 3B.

In the upper rib 11 and lower rib 12, the face portion 3 has a thickness Tr equal to or less than the thickness TC in the central region 10.

If the thickness Tr is too small, the face portion 3 is liable to decrease in the durability in its peripheral part. If the thickness Tr is more than the thickness TC, the rebound performance is greatly decreased. Especially, the carry distance at the time of off-center shots is greatly decreased because the rigidity of the surrounding part of the central region 10 is largely increased. Therefore, the thickness Tr is preferably set in a range of not less than 90%, more preferably not less than 93% of the thickness Tc in the central region 10. In this Embodiment, the thickness Tr in the upper rib 11 is substantially same as the thickness Tr in the lower rib 12. But these can be different values. For example, in order to increase the strength of the lower part of the face portion, the lower rib 12 can be formed with a larger thickness than that of the upper rib 11. Further, in each of the upper rib 11 and lower rib 12, the thickness Tr is substantially constant.

Figure 5:
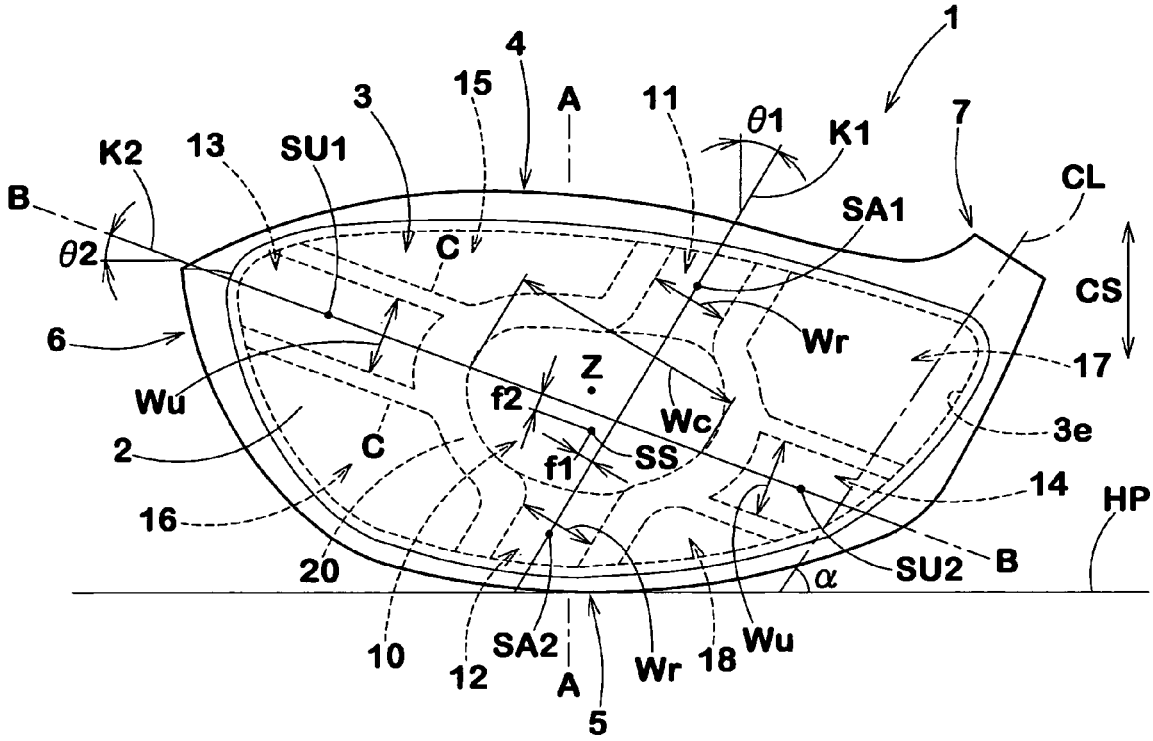
FIG. 5 is a front view of the golf club head showing a thickness distribution of the face portion.

Preferably, the upper rib 11 and lower rib 12 are arranged as follows. AS shown in FIG. 5, in the front view of the head, the upper rib 11 and the lower rib 12 are substantially aligned on a straight line K1 passing through or near the sweat spot SS. The distance f1 between the straight line K1 and the sweet spot SS is not more than 10 mm, preferably not more than 5 mm, more preferably not more than 3 mm.

The straight line K1 is inclined to the heel from the sole portion 5 towards the crown portion 4 at an inclination angle theta1 with respect to the vertical direction.

The inclination angle theta1 is set in a range of not less than 10 degrees, preferably not less than 15 degrees, more preferably not less than 20 degrees, but not more than 40 degrees, preferably not more than 35 degrees, more preferably not more than 33 degrees, still more preferably not-more than 30 degrees. As a result, the durability of the face portion 3 is effectively increased. Meanwhile, the straight line K1 becomes almost perpendicular to the above-mentioned aslant straight line N along which the hitting positions of the average golfers concentrate.

When measured perpendicularly to the straight line K1 in the front view, the width Wr of the upper rib 11 and the width Wr of the lower rib 12 are preferably less than the maximum width Wc of the central region 10. The width ratio (Wr/Wc) is preferably set in a range of not less than 0.20, more preferably not less than 0.25, but not more than 0.50, more preferably not more than 0.40. As a result, it becomes possible to reduce the weight of the face portion 3 without sacrificing the durability. Further, an excessive increase of the restitution coefficient of the club head can be avoided.

In this embodiment, the each of the ribs 11 and 12 has a substantially constant width Wr. But, it is also possible to vary the width Wr. For example, the rib 11 and/or 12 can be gradually increased in the width from the center towards the peripheral edge of the face portion.

Further, the width Wr of the upper rib 11 is the same as the width Wr of the lower rib 12. But, these can be different widths. For example, the lower rib 12 can be formed as being wider than the upper rib 11 in order to improve the durability of the lower part of the face.

If the upper rib 11 and lower rib 12 are too small, it is difficult to provide the necessary durability for the face portion 3. If too large, the rebound performance is deteriorated, and the face portion 3 is increased in the weight and the depth of the center of gravity is decreased, and as a result, the directionality of the hit ball becomes worse. Therefore, the total (Sru+Srd) of the area Sru in the front view of the upper rib 11 and the area Srd in the front view of the lower rib 12 is preferably set in a range of not less than 6%, more preferably not less than 7%, but preferably not more than 17%, more preferably not more than 14% of the area in the front view of the rear face 3B of the face portion 3.

The upper rib 11 and lower rib 12 may be extended to the peripheral edge 3*e* of the rear face 3B in the case that the face plate 1A is provided with the upper turnback 9*a* and lower turnback 9*b* as shown in FIG. 3.

In the case that the face plate 1A is not provided with the upper turnback 9*a* and lower turnback 9*b* as shown in FIG. 4, the upper rib 11 and lower rib 12 may be extended to the upper edge and lower edge of the face plate 1A, respectively.

In any case, the centroid SA1 of the area Sru of the upper rib 11 and the centroid SA2 of the area Srd of the lower rib 12 are positioned on the above-mentioned straight line K1.

In the toe-side groove 13 and heel-side groove 14, the face portion 3 becomes thinnest. This facilitates the weight reduction in the face portion 3. Further, even if the ball hitting position is on the toe-side or heel-side of the sweet spot SS, a certain degree of deflection can be obtained, and a large decrease in the rebound performance can be avoided to prevent the carry distance from decreasing.

If the thickness Tt in the toe-side groove 13 and the thickness Th in the heel-side groove 14 are too small, the durability of the face portion 3 decreases. Therefore, the thicknesses Tt and Th are preferably set in a range of not less than 1.70 mm, more preferably not less than 1.85 mm. However, if the thicknesses Tt and Th are too large, the deflection of the face portion 3 at the aforementioned off-center shots becomes insufficient, and as a result, a loss of the carry distance increases. Therefore, the thicknesses Tt and Th are preferably set in a range of not more than 2.30 mm, more preferably not more than 2.15 mm.

Especially, in relation to the thickness TC in the central region 10, the ratio (Tc/Tt) and ratio (Tc/Th) are preferably set in a range of from 1.40 to 2.00. If these ratios become too large, the rebound performance may be improved, but there is a drawback such that a stress concentrates between the groove 13, 14 and the central region 10. If these ratios become decreased, there is a possibility that the rebound performance decreases.

In this Embodiment, the thickness Tt in the toe-side groove 13 is substantially same as the thickness Th in the heel-side groove 14. Further, the thicknesses Tt and Th are substantially constant in the respective grooves 13 and 14.

Preferably, the toe-side groove 13 and heel-side groove 14 are arranged as follows. As shown in FIG. 5, in the front view of the head, the toe-side groove 13 and heel-side groove 14 are substantially aligned on a straight line K2 passing through or near the sweat spot SS. The distance f2 between the straight line K2 and the sweet spot SS is preferably set in a range of not more than 10 mm, more preferably not more than 5 mm, further preferably not more than 3 mm.

The straight line K2 is inclined to the crown portion 4 from the heel towards the toe at an inclination angle theta2 of from 10 to 40 degrees with respect to the horizontal direction. Thus, the straight line K2 becomes almost parallel to the above-mentioned aslant straight line N along which the hitting positions of the average golfers concentrate.

When measured perpendicularly to the straight line K2, the width Wu of the toe-side groove 13 and the width Wu of the heel-side groove 14 are in a range of not less than 5 mm, preferably not less than 7 mm, more preferably not less than 10 mm, but not more than 30 mm, preferably not more than 25 mm, more preferably not more than 20 mm. If the width Wu is less than 5 mm, stress concentration occurs on the grooves and the durability is liable to decrease. If the width Wu is more than 30 mm, stress concentration occurs between the groove and the peripheral edge of the face portion 3, and the durability is decreased.

If the toe-side groove 13 and the heel-side groove 14 are too small, when the ball hitting position is on the toe-side or heel-side of the sweet spot, it is difficult to sufficiently deflect the hit part of the face portion 3 and as a result the rebound performance is decreased. If too large on the other hand, the durability of the face portion 3 is decreased. Therefore, the total (St+Sh) of the area St in the front view of the toe-side groove 13 and the area Sh in the front view of the heel-side groove 14 is preferably set in a range of not less than 8%, more preferably not less than 9%, but not more than 20%, more preferably not more than 18% of the above-mentioned area of the rear face 3B of the face portion 3.

Preferably, the area ratio (St/Sh) is set in a range of from about 0.8 to about 1.2.

The toe-side groove 13 and the heel-side groove 14 may be extended to the peripheral edge 3*e* of the rear face 3B in the case that the face plate 1A is provided with the turnbacks 9*a* and 9*c* and the turnbacks 9*b* and 9*d* as shown in FIG. 3.

In the case that the face plate 1A is not provided with the turnbacks as shown in FIG. 4, the toe-side groove 13 and the heel-side groove 14 may be extended to or near(preferably about 2 or 3 mm short) the peripheral edge of the face plate 1A. In any case, the centroid SU1 of the area St of the toe-side groove 13 and the centroid SU2 of the area Sh of the heel-side groove 14 are positioned on the straight line K2.

By the two ribs 11 and 12 and two grooves 13 and 14, the rear face 3B is provided with the four regions 15, 16, 17 and 18 as substantially flat regions.

A) The toe-side upper region 15 has a thickness Tto between the thicknesses Tr and Tt in the adjacent upper rib 11 and adjacent toe-side groove 13. (Tr>Tto>Tt)

B) The toe-side lower region 16 has a thickness Tto between the thicknesses Tr and Tt in the adjacent lower rib 12 and adjacent toe-side groove 13. (Tr>Tto>Tt)

C) The heel-side upper region 17 has a thickness Tho between the thicknesses Tr and Th in the adjacent upper rib 11 and adjacent heel-side groove 14. (Tr>Tho>Th)

D) The heel-side lower region 18 has a thickness Tho between the thicknesses Tr and Th in the adjacent lower rib 12 and adjacent heel-side groove 14. (Tr>Tho>Th)

In the respective combinations A), B), C) and D), the thicknesses Tto and Tho are set in relation to the thickness Tr. Namely, the ratio (Tr/Tto) and the ratio (Tr/Tho) are set in a range of not less than 1.22, preferably not less than 1.25, but not more than 1.50, preferably not more than 1.45.

Further, in the respective combinations A), B), C) and D), the ratio (Tto/Tt) and the ratio (Tho/Th) are set in a range of not less than 1.08, preferably not less than 1.10, but not more than 1.24, preferably not more than 1.21.

In connection with the absolute value of the thickness, if these middle-thickness regions 15-18 are too thin, there is a possibility that the durability becomes insufficient, and the rebound performance becomes increased over the limitation specified in the golf rules. If too thick on the other hand, there is a possibility that the rebound performance is lowered, and the head weight is increased in the face portion 3.

In this light, it is preferable that the thickness Tto of the toe-side upper region 15, the thickness Tto of toe-side lower region 16, the thickness Tho of the heel-side upper region 17, and the thickness Tho of the heel-side lower region 18 are each set in a range of not less than 1.90 mm, more preferably not less than 2.00 mm, but not more than 2.50 mm, more preferably not more than 2.35 mm.

In this embodiment, the regions 15-18 are the same thickness (namely, Tto=Tho), but it is possible that the regions 15-18 has two or three or four different thicknesses. Further, in each of the region 15-18, the thickness Tto, Tho is constant. But, it is also possible to vary the thickness within the above range.

In order to improve both of the durability of the face portion 3 and the rebound performance in a well balanced manner, the total (Stu+Std+Shu+Shd) of the area Stu of the toe-side upper region 15, the area Std of the toe-side lower region 16, the area Shu of the heel-side upper region 17 and the area Shd of the heel-side lower region 18 each in the front view, is preferably set in a range of not less than 27%, more preferably not less than 28%, but not more than 50%, more preferably not more than 48% of the above-mentioned area of the rear face 3B of the face portion 3.

Figure 6:
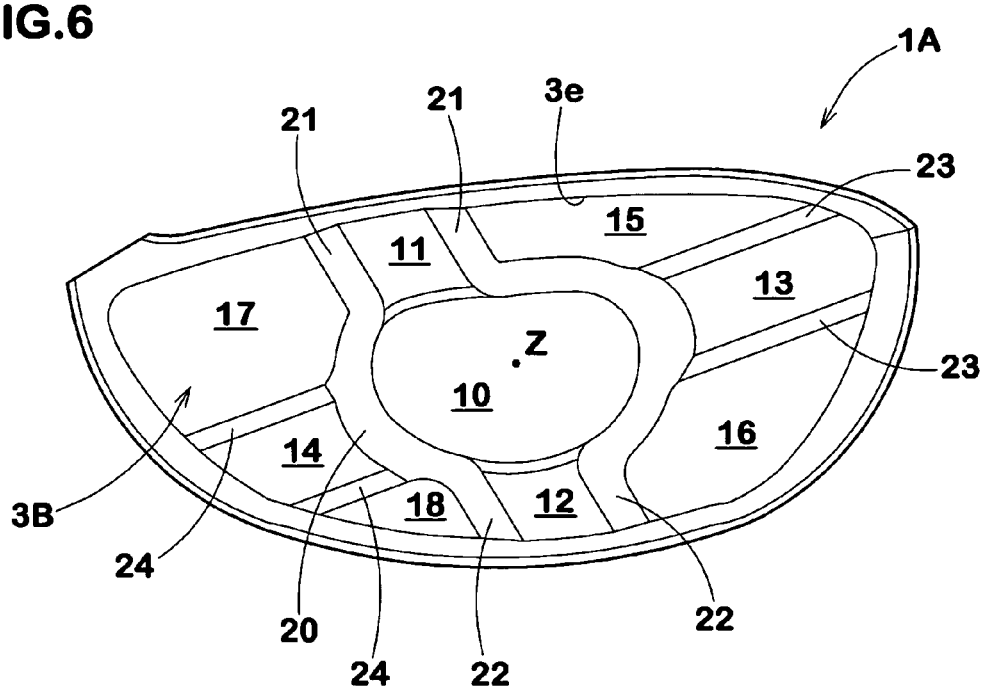
FIG. 6 is a back view of the face portion.
Figure 7:
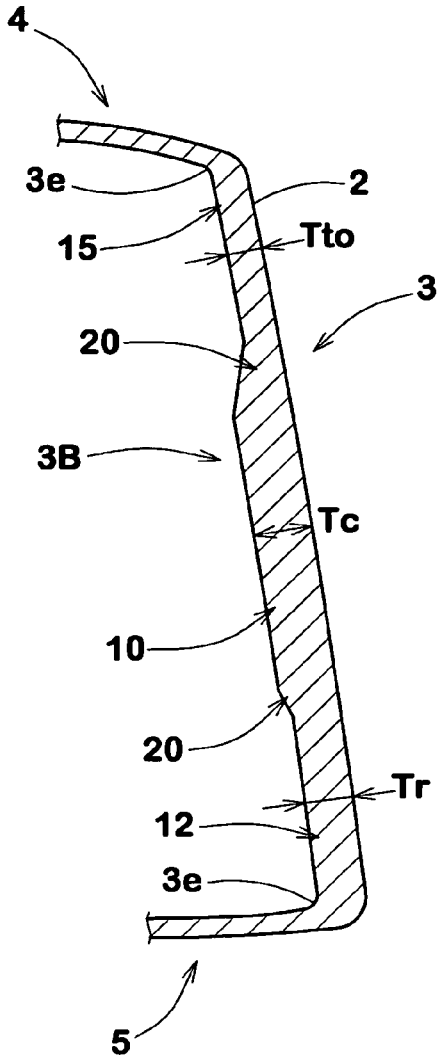
FIG. 7 is a cross sectional view taken along line A-A in FIG. 5.
Figure 8:
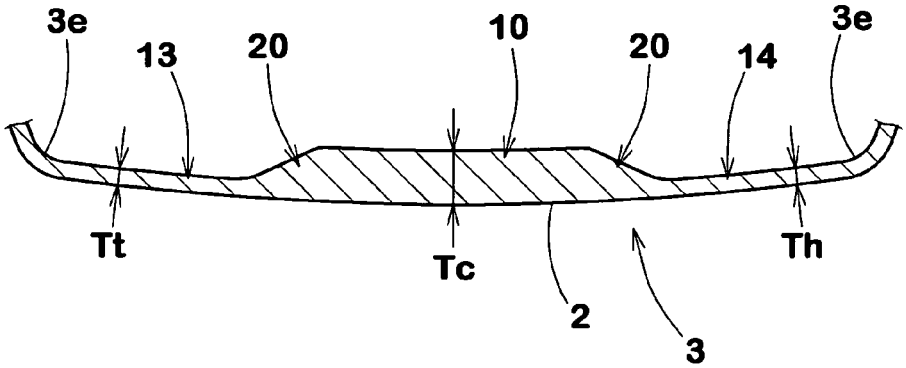
FIG. 8 is a cross sectional view taken along line B-B in FIG. 5.
Figure 9:
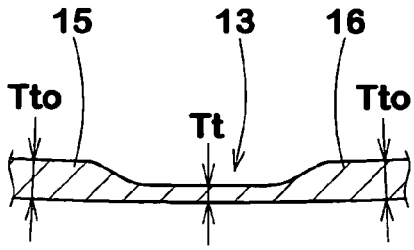
FIG. 9 is a cross sectional view taken along line C-C in FIG. 5.
Figure 10:
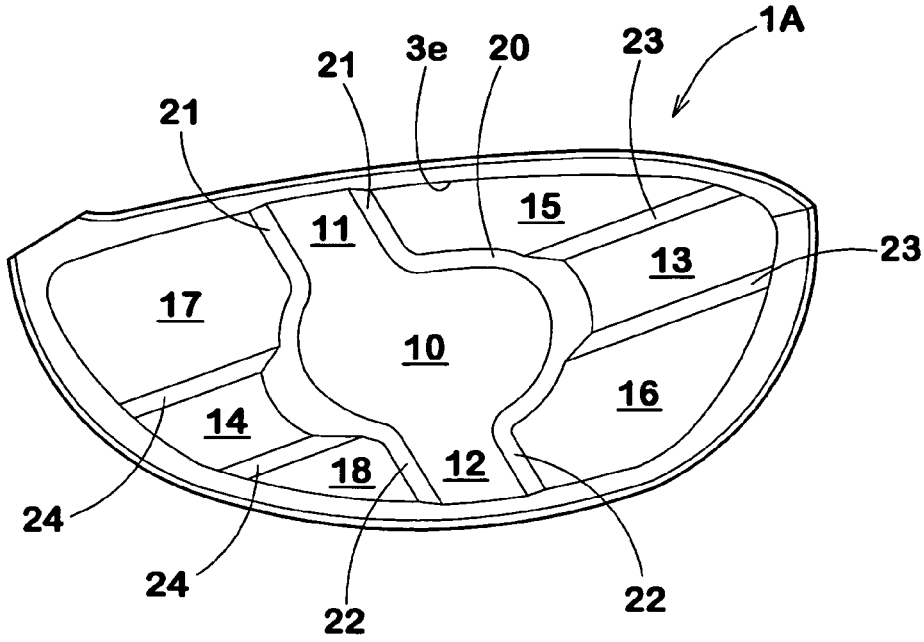
FIG. 10 is a back view of another example of the face portion.
Figure 11:
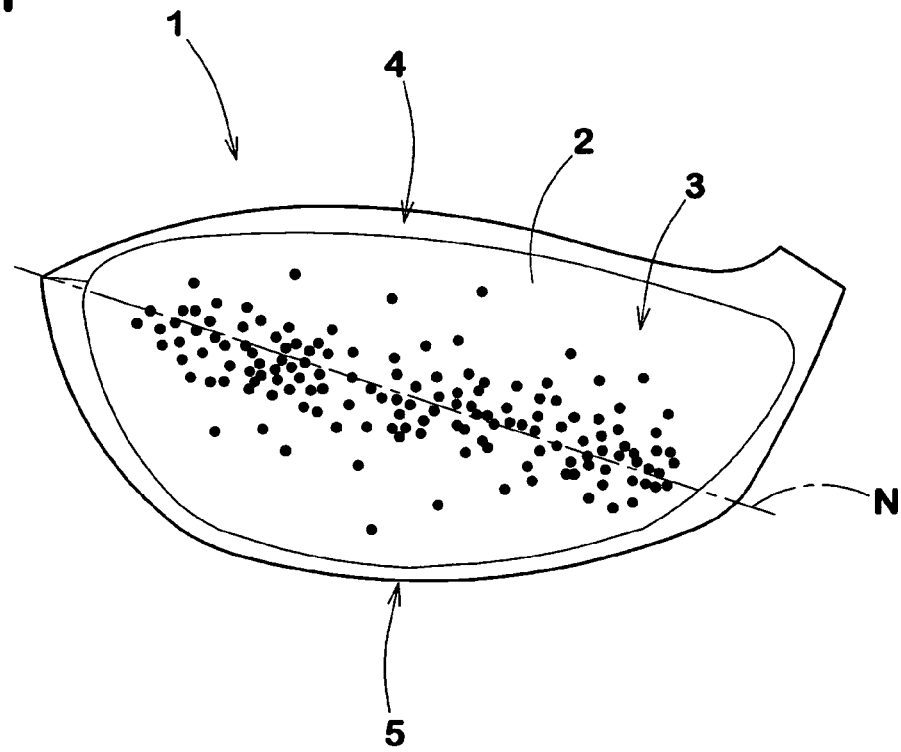
FIG. 11 is a distribution map of hitting positions of the average golfers.
Figure 12:
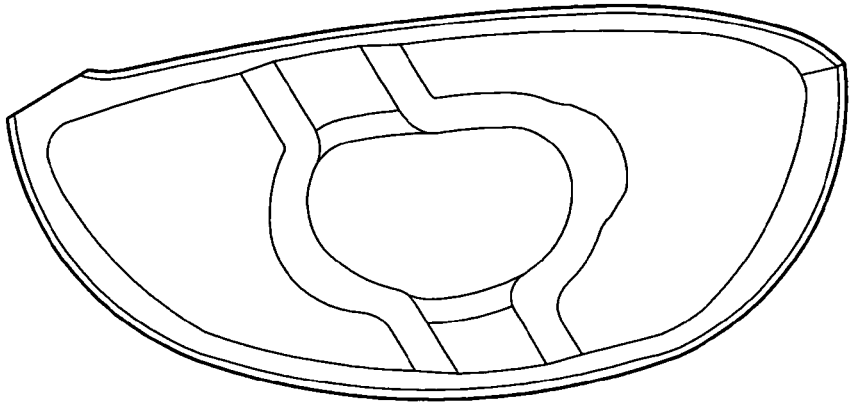
FIGS. 12, 13, 14 and 15 are back views of face portions of club heads used in the undermentioned comparison tests.
Figure 13:
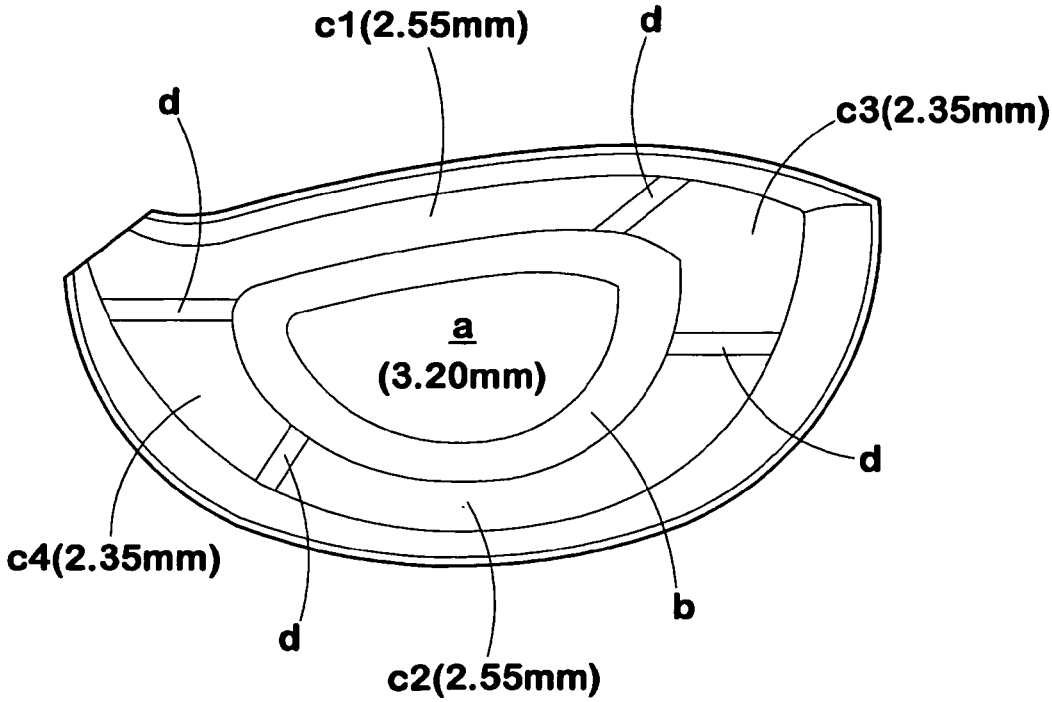
Figure 14:
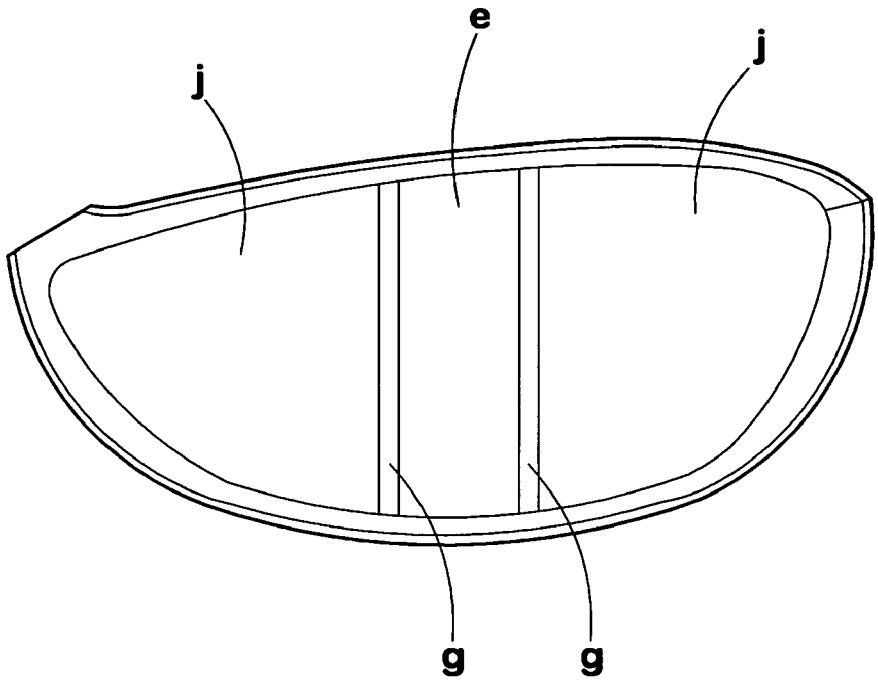
Figure 15:
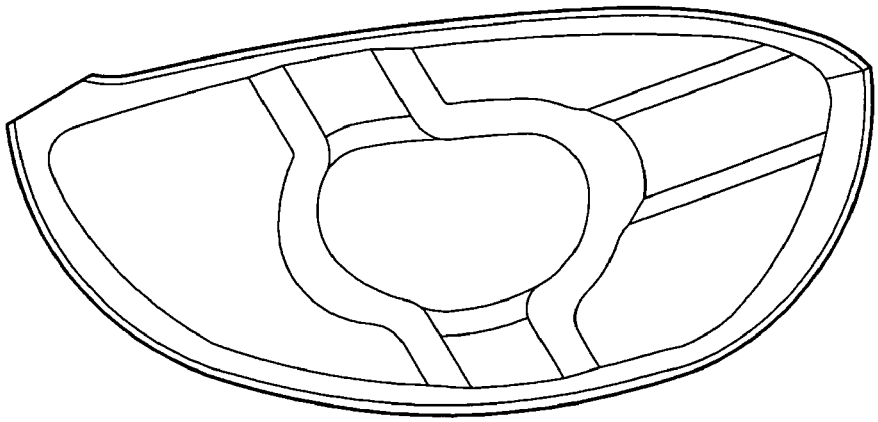

Further, In this embodiment, as shown in FIGS. 6 and 10, on each side of the upper rib 11, there is formed a thickness transitional zone 21 whose thickness is gradually decreased from the thickness Tr in the upper rib 11 to the thickness Tto, Tho of the adjacent region 15, 17.

On each side of the lower rib 12, there is formed a thickness transitional zone 22 whose thickness is gradually decreased from the thickness Tr in the lower rib 12 to the thickness Tto, Tho of the adjacent region 16, 18.

On each side of the toe-side groove 13, there is formed a thickness transitional zone 23 whose thickness is gradually increased from the thickness Tt in the toe-side groove 13 to the thickness Tto of the adjacent region 15, 16.

On each side of the heel-side groove 14, there is formed a thickness transitional zone 24 whose thickness is gradually increased from the thickness Th in the heel-side groove 14 to the thickness Tho of the adjacent region 17, 18.

Further, around the central region 10, there is formed a thickness transitional zone 20 whose thickness is gradually decreased to the adjacent thicknesses. The thickness transitional zones 20-25 prevent stress concentration and increase the durability of the face portion 3.

When Tr<Tc as shown in FIG. 6, the thickness transitional zone 20 is annular. However, when Tr=Tc as shown in FIG. 10, the thickness transitional zone 20 is interrupted by the ribs 11 and 12.

Comparison Tests

Wood golf club heads were prepared and tested for the rebound performance and durability.

The structures of all of the heads were same except for the pattern of the rear face of the face portion, namely, the thickness distribution.

Each club head had a two-piece structure, as shown in FIG. 3, comprising, a main shell formed as a lost-wax precision casting of Ti-6Al-4V and a face plate with a turnback formed by hot forging Ti-6Al-4V and fixed to the front of the main shell by Tig welding.

The head volume was 460 cc, and the area of the rear face of the face portion was 43.0 sq.mm.

Ex.1-Ex.4 were provided with patterns based on the pattern shown in FIG. 6.

Ref.1-Ref.4 were provided with patterns shown in FIG. 12-FIG. 15, respectively.

In Ref.1(FIG. 12), the pattern corresponds to a pattern of FIG. 6 from which the toe-side groove and heel-side groove were omitted.

In Ref.2(FIG. 13), the pattern comprises: a central region (a); a thickness transitional zone (b) surrounding the central region (a) and having a thickness gradually decreasing toward the peripheral edge of the face portion; four narrow-width, rib-like thickness transitional zones (d) extending radially from the thickness transitional zone (b); and four region c1, c2, c3 and c4 between the rib-like zones (d). The thicknesses of the regions a, c1, c2, c3 and c4 are indicated between parentheses in the figure.

In Ref.3(FIG. 14), the pattern comprises: a relatively wide rib-like thickest central region (e) extending in the crown-and-sole direction; a thickness transitional zone (g) formed on each side of the region (e); and two broad thin regions (j).

In Ref.4(FIG. 15), the pattern corresponds to a pattern of FIG. 6 from which the heel-side groove was omitted.

The specifications are shown in Table 1.

Rebound Performance Test

According to the "Procedure for Measuring the velocity Ratio of a Club Head for conformance to Rule 4-1e, Appendix II, Revision 2 (Feb. 8, 1999), United States Golf Association", the restitution coefficient (e) of each club head was measured at three measuring positions.

In addition to the sweet spot, a toe-side position 20 mm toe-side from the sweet spot and a heel-side position 20 mm heel-side from the sweet spot were added as the measuring positions.

The results are shown in Table 1, wherein the restitution coefficient at the toe-side position and that at the heel-side position are indicated by an index based on the restitution coefficient at the sweet spot being 100.

Durability Test

Each head was attached to a carbon shaft (SRI Sports Ltd. SV-30033, Flex X) to make a 45-inch driver, and the golf club was mounted on a swing robot. Then, the head hit golf balls at the sweet spot 10000 times at the maximum, while visually checking the head every 100 times. The head speed was 54 meter/second.

The results are shown in Table 1, wherein "A" means that no damage was found after the 10000-time hitting test, and numerical values mean the number of hitting times at which a damage was observed.

TABLE 1

| Head | Ex. 1 | Ex. 2 | Ex. 3 | Ex. 4 | Ref. 1 | Ref. 2 | Ref. 3 | Ref. 4 |
|---|---|---|---|---|---|---|---|---|
| Thickness (mm) | | | | | | | | |
| Tc: Central region | 3.52 | 3.55 | 3.49 | 3.55 | 3.50 | 3.20 | 3.58 | 3.53 |
| Tto, Tho: Middle-thickness part | 2.30 | 2.22 | 2.33 | 2.20 | 2.25 | 2.55 | 2.27 | 2.31 |
| Tt, Th: Groove | 1.98 | 2.03 | 2.08 | 2.05 | — | 2.35 | — | 2.05 |
| Tr: Rib | 3.30 | 3.28 | 3.25 | 3.29 | 3.30 | — | 3.58 | 3.27 |
| Tc/Tr | 1.07 | 1.08 | 1.07 | 1.08 | 1.06 | — | 1.00 | 1.08 |
| Tr/Tto, Tr/Tho | 1.43 | 1.48 | 1.39 | 1.50 | 1.47 | — | 1.58 | 1.42 |
| Tto/Tt, Tho/Th | 1.16 | 1.09 | 1.12 | 1.07 | — | 1.09 | — | 1.13 |
| Tc/Tt, Tc/Th | 1.78 | 1.75 | 1.68 | 1.73 | — | 1.36 | — | 1.72 |
| Angle theta1 (deg.) | 20 | 20 | 33 | 45 | 20 | — | 0 | 20 |
| Angle theta2 (deg.) | 10 | 15 | 25 | 0 | — | 15 | — | 15 |
| Area (sq.cm) | | | | | | | | |
| Sc: Central region | 7.5 | 7.0 | 7.3 | 7.0 | 8.0 | 8.6 | — | 7.8 |
| Sru: Upper rib | 2.1 | 2.3 | 2.5 | 2.2 | 2.5 | | | 3.0 |
| Srd: Lower rib | 2.2 | 2.3 | 2.4 | 2.1 | 2.5 | | | 2.7 |
| St: Toe-side groove | 3.5 | 3.8 | 3.5 | 3.4 | 0 | | | 4.4 |
| Sh Heel-side groove | 2.0 | 2.0 | 2.5 | 2.3 | 0 | | | 0 |
| Stu: Toe-side upper region | 3.5 | 3.5 | 3.3 | 2.9 | 0 | | | 3.0 |
| Std: Toe-side lower region | 5.2 | 5.4 | 5.4 | 7.6 | 0 | | | 4.5 |
| Shu Heel-side upper region | 6.5 | 6.7 | 6.5 | 8.3 | 0 | | | — |
| Shd Heel-side lower region | 1.7 | 1.6 | 1.5 | 0.7 | 0 | | | — |
| Distance (mm) | | | | | | | | |
| f1: Line K1 and Sweet spot | 3.0 | 3.8 | 5.0 | 7.4 | 3.5 | — | 2.0 | 4.0 |
| f2: Line K2 and Sweet spot | 5.0 | 5.0 | 3.5 | 4.5 | — | — | — | — |

TABLE 1-continued

| Head | Ex. 1 | Ex. 2 | Ex. 3 | Ex. 4 | Ref. 1 | Ref. 2 | Ref. 3 | Ref. 4 |
|---|---|---|---|---|---|---|---|---|
| Rebound performance | | | | | | | | |
| Sweet spot | 100 | 100 | 100 | 100 | 100 | 100 | 100 | 100 |
| Toe-side | 88 | 92 | 90 | 78 | 80 | 65 | 75 | 90 |
| Heel-side | 82 | 85 | 79 | 67 | 70 | 60 | 65 | 65 |
| Durability | A | A | A | 6500 *1 | A | A | 7700 *2 | A |

*1 Lower part of Face portion was cracked
*2 Face portion was broken

From the test results, it was confirmed that the decrease in the restitution coefficient or rebound performance at the time of off-center shots can be minimized, and accordingly, the loss of the carry distance is also minimized, without sacrificing the durability practically.

The invention claimed is:

1. A golf club head comprising:

a face portion having a front face defining the club face and a rear face facing a hollow;

a crown portion; and a sole portion, wherein said face portion is provided on the rear face with: a central region defining the largest thickness of the face portion; an upper rib extending from the central region toward the crown portion; a lower rib extending from the central region toward the sole portion; a toe-side groove extending from the central region toward the toe; a heel-side groove extending from the central region toward heel; a toe-side upper region between the toe-side groove and the upper rib; a toe-side lower region between the toe-side groove and the lower rib; a heel-side upper region between the heel-side groove and the upper rib; and a heel-side lower region between the heel-side groove and the lower rib, so as to have a thickness distribution satisfying each of the following thickness magnitude relations:

Central region≧Upper rib;

Central region≧Lower rib;

Upper rib>Toe-side upper region>Toe-side groove;

Lower rib>Toe-side lower region>Toe-side groove;

Upper rib>Heel-side upper region>Heel-side groove; and

Lower rib>Heel-side lower region>Heel-side groove.

2. The golf club head according to claim 1, wherein both of the upper rib and the lower rib extend along a first straight line, the first straight line inclined to the heel from the sole portion towards the crown portion at an inclination angle of from 10 to 40 degrees with respect to the crown-and-sole direction.

3. The golf club head according to claim 2, wherein the upper rib and lower rib each have a centroid on the first straight line.

4. The golf club head according to claim 1, wherein both of the toe-side groove and the heel-side groove extend along a second straight line, the second straight line inclined to the heel from the toe towards the heel at an inclination angle of from 10 to 40 degrees with respect to the toe-and-heel direction.

5. The golf club head according to claim 4, wherein the toe-side groove and heel-side groove each have a centroid on the second straight line.

6. The golf club head according to claim 1, wherein both of the upper rib and the lower rib extend along a first straight line, the first straight line inclined to the heel from the sole portion towards the crown portion at an inclination angle of from 10 to 40 degrees with respect to the crown-and-sole direction, and both of the toe-side groove and the heel-side groove extend along a second straight line, the second straight line inclined to the heel from the toe towards the heel at an inclination angle of from 10 to 40 degrees with respect to the toe-and-heel direction.

7. The golf club head according to claim 6, wherein the upper rib and lower rib each have a centroid on the first straight line.

8. The golf club head according to claim 6, wherein the toe-side groove and heel-side groove each have a centroid on the second straight line.

9. The golf club head according to claim 1, wherein the central region has a thickness of from 3.10 to 4.00 mm, the toe-side upper region has a thickness of from 1.90 to 2.50 mm, the toe-side lower region has a thickness of from 1.90 to 2.50 mm, the heel-side upper region has a thickness of from 1.90 to 2.50 mm, and the heel-side lower region has a thickness of from 1.90 to 2.50 mm.

10. The golf club head according to claim 1, wherein the central region has an area not less than 13 % of the area of the face portion in the front view of the head.

11. The golf club head according to claim 1, wherein the width Wr of the upper rib and the width Wr of the lower rib are smaller than the maximum width Wc of the central region when measured in the direction perpendicular to the first straight line.

12. The golf club head according to claim 11, wherein the width ratio Wr/Wc is in a range of not less than 0.20, but not more than 0.50.

13. The golf club head according to claim 1, wherein the thickness in the upper rib and the thickness in the lower rib are smaller than the thickness in the central region.

14. The golf club head according to claim 1, wherein the width of the toe-side groove and the width of the heel-side groove are not less than 5 mm.

* * * * *